US005802781A

United States Patent [19]

Eickhof

[11] Patent Number: 5,802,781

[45] Date of Patent: Sep. 8, 1998

[54] SOFFIT LOCK

[75] Inventor: John K. Eickhof, R.R. 2, Box 11, Edgewood, Crookson, Minn. 56716

[73] Assignees: John K. Eickhof, Crookston; Paul Eickhof, Erskine, both of Minn.

[21] Appl. No.: 678,293

[22] Filed: Jul. 11, 1996

[51] Int. Cl.[6] ..... E04H 13/00

[52] U.S. Cl. ..... 52/146; 52/84; 52/713; 52/714; 411/389

[58] Field of Search ..... 52/94, 95, 136, 52/713, 714, 698; 411/389

[56] References Cited

U.S. PATENT DOCUMENTS

| | | | |
|---|---|---|---|
| 1,300,173 | 4/1919 | Kennedy . | |
| 2,814,942 | 12/1957 | Sinner et al. . | |
| 3,655,065 | 4/1972 | Yellin . | |
| 3,754,805 | 8/1973 | Pangburn et al. . | |
| 3,879,096 | 4/1975 | Blodee . | |
| 3,897,663 | 8/1975 | Gaul . | |
| 4,000,596 | 1/1977 | Magill et al. | 52/714 X |
| 4,068,425 | 1/1978 | Czorniak . | |
| 4,073,100 | 2/1978 | DiGiovanni, Jr. . | |
| 4,296,580 | 10/1981 | Weinar | 52/714 X |
| 4,333,286 | 6/1982 | Weinar | 52/714 X |
| 4,614,066 | 9/1986 | Koppenberg . | |
| 4,644,711 | 2/1987 | Eickhof . | |
| 5,195,812 | 3/1993 | Eickhof . | |

FOREIGN PATENT DOCUMENTS

| | | | |
|---|---|---|---|
| 661711 | 6/1938 | Germany | 411/389 |

*Primary Examiner*—Lanna Mai
*Assistant Examiner*—Timothy B. Kang
*Attorney, Agent, or Firm*—Merchant, Gould, Smith, Edell, Welter & Schmidt

[57] ABSTRACT

A soffit lock retains a facing stone or shutter to a cap stone soffit. The soffit lock attaches on the inner surface of the shutter and includes a hook portion wrapping around and over the top of the shutter. A shelf portion includes an orifice formed therethrough which is threaded to receive a stud member. The stud member extends upward and can be raised to engage a bore formed in the soffit.

14 Claims, 3 Drawing Sheets

SOFFIT LOCK

BACKGROUND OF THE INVENTION

1. Field of the Invention

The present invention is directed to a mounting apparatus for mounting a shutter to a soffit.

2. Prior Art

There are many applications wherein stone or other facing is desired and at least portions of the facing are removable to obtain access behind the facing. Common applications include columbariums and mausoleums. Stone facing in a columbarium or mausoleum presents a very rich appearance and provides a solemn and reverent atmosphere. However, in order to provide the proper dignified appearance, it is desirous to minimize decorations, brackets and other mounting hardware which protrude from the facing. Usually, each niche or crypt has a single stone shutter which combines with adjacent shutters to form an extended vertical facing surface.

Mounting or hanging devices for holding facing slabs or shutters to columbarium or mausoleum structures are well known. An example is shown in U.S. Pat. No. 4,644,711 to Eickhof. Although the Eickhof '711 patent describes mounting hardware which minimizes the portion of the hardware which is visible, it does not address all the problems. The hardware works fine for supporting slabs along the wall, but does not adequately address the mounting problem wherein a top shutter engages a soffit of the supporting structure or top of the border stone. It can be appreciated that this provides special problems which require special mounting hardware to mount to the lower surface.

It can be seen then that new and improved retaining hardware is needed for mounting facing stones or other elements to a soffit. Such a device should provide for adequately retaining the facing member, while hiding the mounting hardware. In addition, such mounting hardware should provide for sufficient strength to prevent failure of the hardware and resist vandalism and other destructive elements such as wind and weather. The present invention addresses these as well as others associated with mounting shutters to a soffit.

SUMMARY OF THE INVENTION

The present invention is directed to a soffit lock, and in particular to a soffit lock for retaining a facing element under the soffit. It is envisioned that the present invention may be utilized for retaining facing members such as marble or granite stone in a columbarium or mausoleum to retain individual facing stones on the outside of a crypt or niche. The present invention provides for retaining the stone facing member in an easily removable manner.

The present invention includes a first element which attaches to the interior surface and top edge of a facing stone. A hook member extends over an inner portion of the top edge and engages a slot formed into the top edge of the stone or other member. The mounting member includes a serrated surface engaging the inner surface of the facing member to provide for greater area for contacting an adhesive which is used to attach the mounting member to the facing member. The mounting member further includes a shelf-like portion extending inward from the inner surface of the facing member. An orifice is formed therein which receives a threaded retaining member. The retaining member extends upward from the vertical shelf portion and engages the soffit. In a preferred embodiment, the threaded member has a substantially square threaded profile which allows for engagement by a wrench or other member inserted between the top of the facing member and the border stone of the soffit.

The soffit includes a bore formed therein which receives the retaining member therein to retain the upper portion of the facing member in proper position. The lower edge of the facing member is preferably supported in a conventional manner which allows for pivoting the stone outward for removal. In this manner, rotation of the retaining member relative to the orifice threads raises the upper end of the retaining member. The retaining member inserts into the bore and retains the facing member in a properly aligned position. Removal of the facing member is easily accomplished by rotating the retaining member in the opposite direction to lower the upper end and disengage the bore.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT

Figure 1:
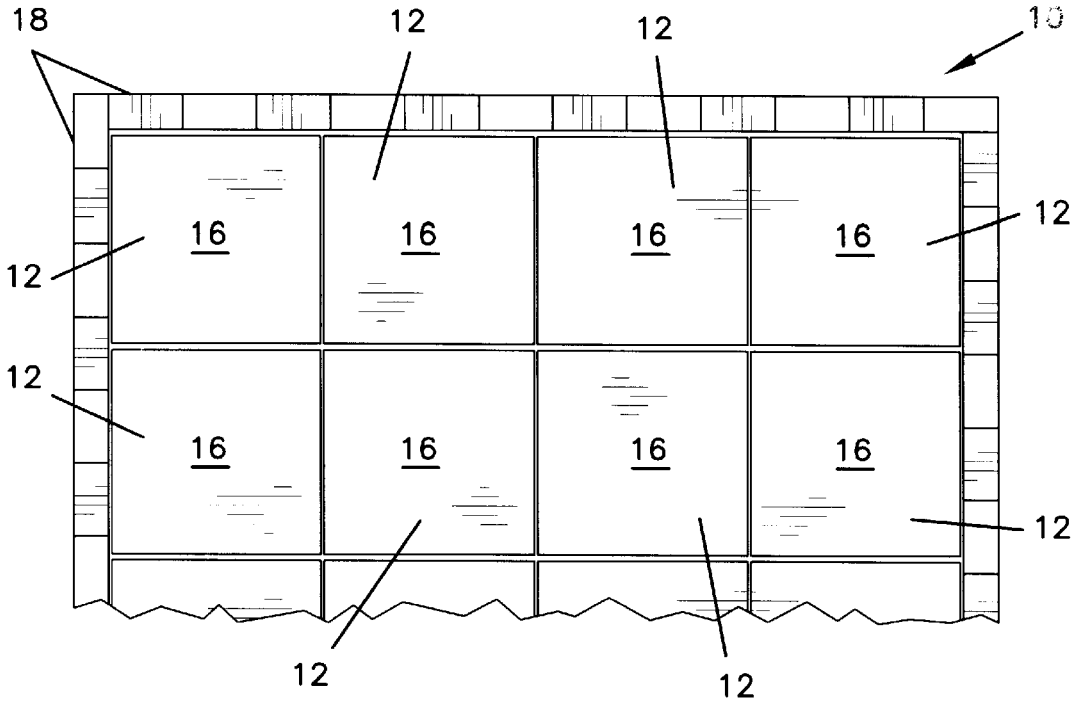
FIG. 1 shows a front plan view of an upper section of a mausoleum or columbarium.

Referring now to the drawings, and in particular to FIG. 1, there is shown a columbarium or mausoleum, generally designated 10. Although a columbarium or mausoleum 10 is shown, it can be appreciated that the present invention is applicable to other structures which require retention of a facing member relative to a soffit. The mausoleum or columbarium 10 includes a number of crypts or niches 12 which have front shutters 16 to form an extended wall presenting a pleasing appearance. It can be appreciated that the height and width of the structure may vary to accommodate the required number of niches or crypts needed at the site. A cap stone 18 forms a decorative border around the top and sides of the shutter plane 16.

Figure 2:
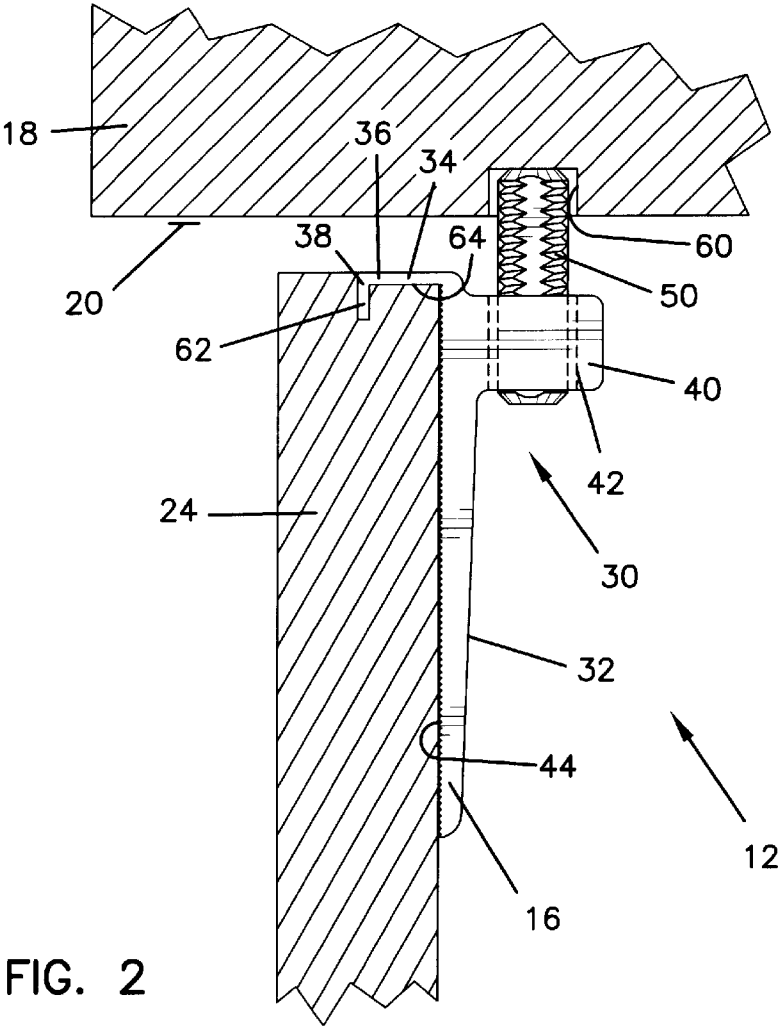
FIG. 2 shows a side sectional view of the front portion of a niche having a soffit lock according to the principles of the present invention.

Referring now to FIG. 2, each niche or crypt 12 includes the shutter 16 forming a front facing. The shutter 16 includes mounting hardware, such as shown in U.S. Pat. No. 4,644,711 issued to Eickhof, and incorporated herein by reference. The mounting hardware is utilized to support the slabs 24 of the shutters 16 to horizontal shelves or other structures of the mausoleum or columbarium 10. At the top end of the columbarium or mausoleum the cap stone 18 forms a soffit 20 relative to the uppermost niche or crypt 12. The top row of shutters 16 are each retained by a soffit lock 30.

Figure 3:
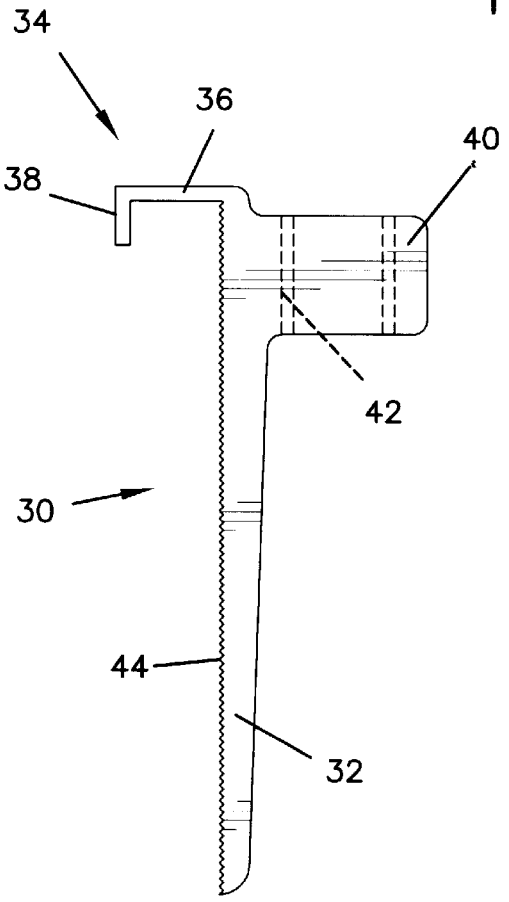
FIG. 3 shows a side elevational view of the soffit lock shown in FIG. 2.
Figure 4:
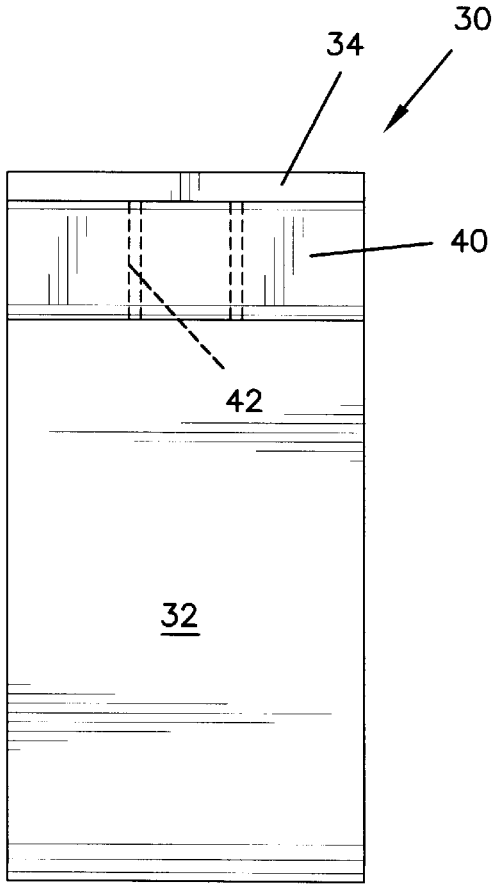
FIG. 4 shows a rear elevational view of the soffit lock shown in FIG. 3.
Figure 9:
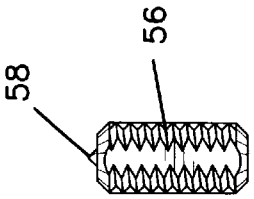
FIG. 9 shows a side elevational view of an installation stud member.

As shown in FIGS. 3 and 4, the soffit lock 30 includes a vertically extending planar portion 32 with an upper wrap-around hook portion 34. The hook portion 34 includes a horizontal portion 36 and an end vertical portion 38. A shelf portion 40 extends from an opposite side of the planar portion 32 and includes a threaded orifice 42 extending vertically therethrough. The opposite side of the planar portion 32 includes a serrated surface 44 in the preferred embodiment for better attachment, as explained hereinafter.

Figure 8:
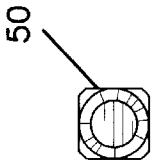
FIG. 8 shows an end view of the threaded stud member shown in FIG. 7.
Figure 7:
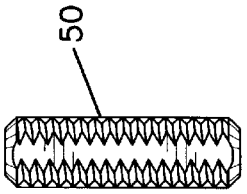
FIG. 7 shows a side elevational view of a threaded square stud member for the soffit lock shown in FIG. 3.

The orifice 42 receives a bolt-type stud member 50, shown in FIGS. 7 and 8. In the preferred embodiment, the stud member 50 is threaded and has round threads and a substantially square outermost profile which is slightly tapered at the corners. With this square configuration with straight sides and threaded corners, a wrench may be inserted between the shutter 16 and the soffit 20 to engage the stud 50 for tightening or loosening. The stud 50 inserts into an orifice 60 formed in the soffit 20, as shown in FIG. 2.

To install the soffit lock 30, the stone slab 24 must be prepared. To accommodate the hook portion 34, a slot 62 extending substantially vertically is formed in the top of the stone slab 24. In addition, a portion 64 of the top of the stone slab 24 may be recessed to accommodate the horizontal portion 36 of the hook 34. In this manner, the hook portion 34 is substantially flush with the top edge of the slab 24. In the preferred embodiment, each of the shutters will have a single soffit lock 30 at the center of the slab 24. However, for wider shutters, two or more soffit locks 30 may be utilized. When the slot 62 and recess 64 have been formed, adhesive is applied to the soffit lock 30 and the inner face of stone 24. The serrated surface 44 provides for greater surface area to contact the adhesive and provide a stronger bond between the soffit lock 30 and the slab 24. Once the adhesive is sufficiently hardened and adhered to the rear of the slab 24, it may be mounted to the cap stone 18. However, prior to mounting, the soffit 20 on the cap stone 18 must be prepared.

Figure 6:
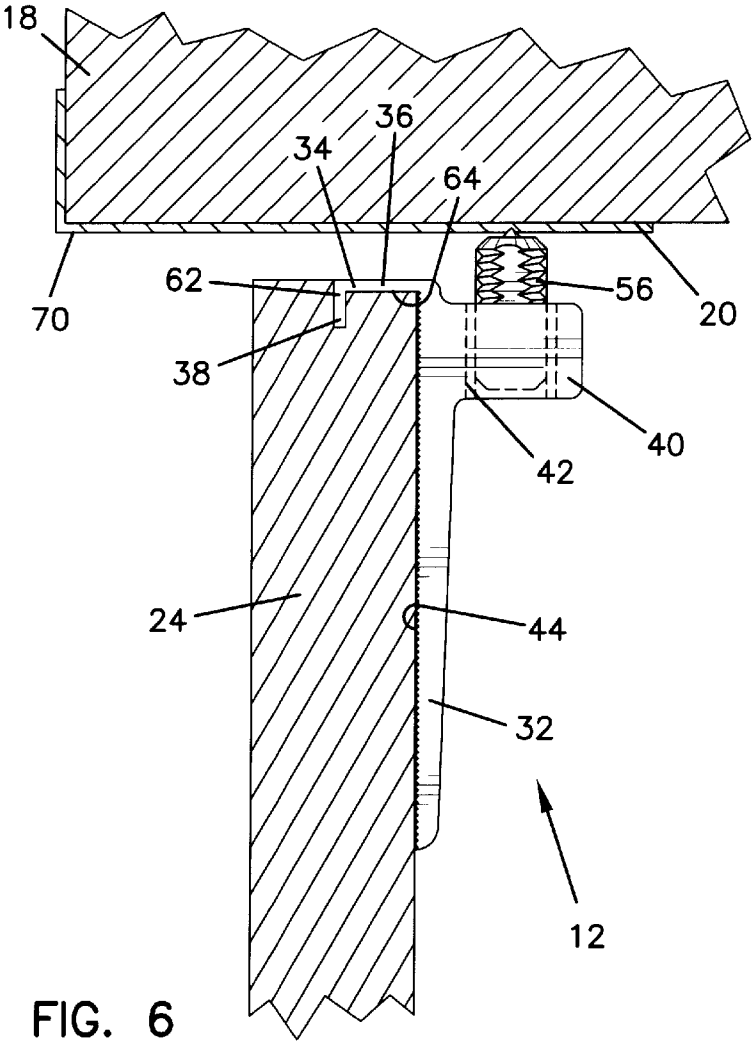
FIG. 6 shows a side sectional view of a niche having a soffit lock showing the installation step of positioning a bore in the soffit.

In a preferred method, as shown in FIG. 6, tape 70 is placed on the soffit 20. In a preferred method, duct tape may be utilized, however other materials may also be used for marking the position of the bore 60, shown in FIG. 2. When the tape 70 has been installed, the shutter 16 having the soffit lock 30 attached thereto is placed in the desired vertical position. A locating stud 56 similar to the stud 50, but being shorter and having a pointed member 58 extending from its upper surface, is utilized in the orifice 42. When the shutter 16 is at the desired position, a wrench is used to turn the substantially square stud 56 until the point 58 engages the tape 70. When a ark has been made into the tape 70, the stud 56 is loosened and the shutter 16 removed. The bore 60 is then drilled utilizing the mark in the tape as the center position. This aligns the bore 60 with the stud member 50 to retain the shutter 16 in the desired vertical centered position. When the bore 60 has been formed, the locating stud 56 is removed and the normal stud member 50 is reinserted. The shutter 16 may then be replaced and the stud member 50 rotated to raise the stud upward and insert into the bore 60, thereby retaining the shutter 16, as shown in FIG. 2. The bottom of the shutter 16 is supported with gravity and retained with the normal hardware, previously known.

Figure 5:
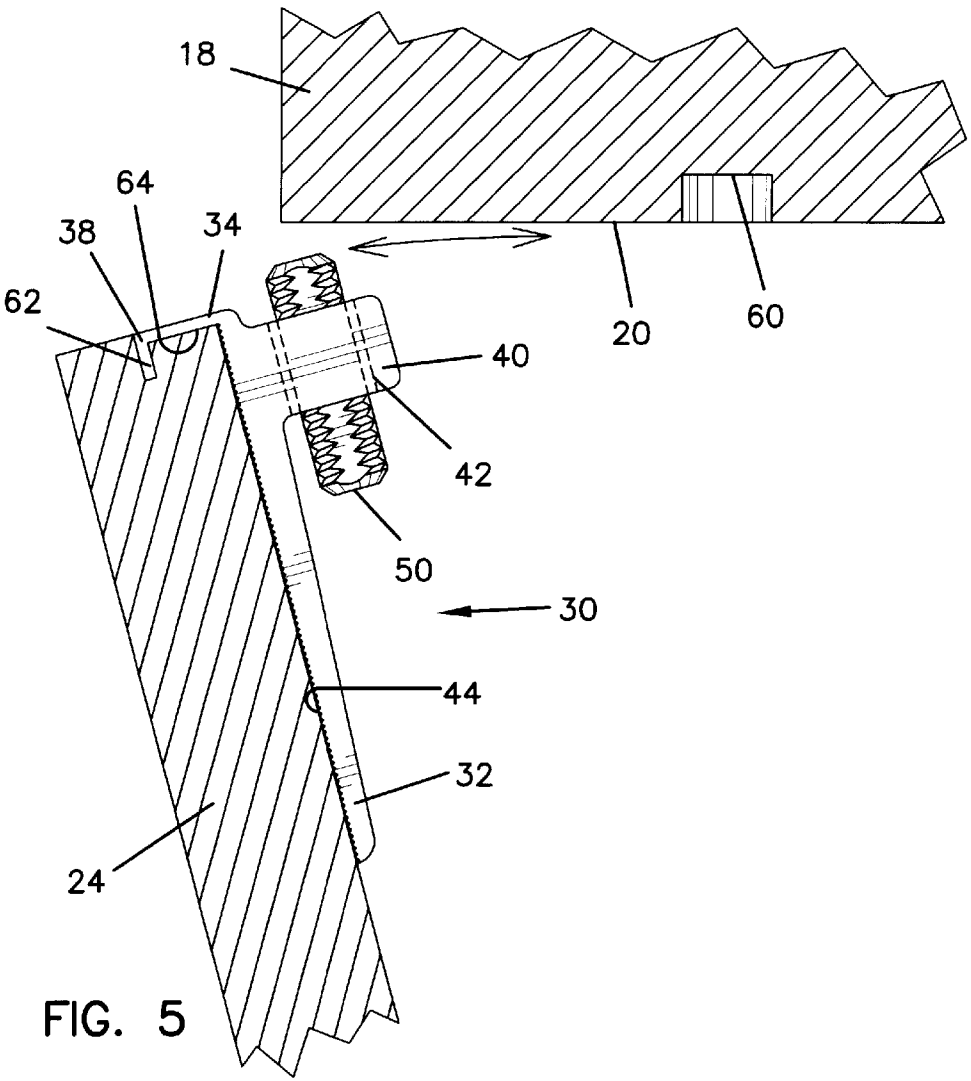
FIG. 5 shows a side sectional view of the front portion of a niche with the facing stone pivoted outward for removal or insertion.

It can be appreciated that the shutters 16 proximate the soffit 20 are easily removable by simply turning the stud member until it clears the bore 60. The shutter 16 may then be pivoted outward to access the niche or crypt 12, as shown in FIG. 5.

TABLE 1

| Mounting Configuration | Load at Failure |
|---|---|
| 1½ inch soffit lock mounted on granite shutter (prior art) | 535 |
| 1½ inch soffit lock mounted on granite shutter (prior art) | 297 |
| 1½ inch soffit lock with wrap-around top portion mounted on granite shutter | 1404 |
| 1½ inch soffit lock with wrap-around top portion mounted on granite shuttter | 1819 |
| 1½ inch soffit lock with wrap-around top portion mounted on marble shutter | 949 |
| 1½ inch soffit lock with wrap-around top portion mounted on marble shutter | 1048 |

It can also be appreciated that with the attachment of the present invention, the bond between the soffit lock 30 and the slab 24 is extremely strong. In a preferred embodiment, the soffit lock 30 is one and one-half inches wide. Test results, as shown in Table 1, indicate that extremely high forces are needed to break the soffit lock 30 away from the slab 24. In the preferred embodiment, the adhesive used is FOILFAST™, made by Rahl Plug Company and provides more strength than the actual stone 24. Tests have shown that with the configuration used, the stone 24 breaks before the adhesive bond fails. It can be appreciated that this configuration provides a stronger mechanical attachment than was possible with previous configurations. Tests performed with soffit locks having a strut extending into a slot formed in the side of the slab 24, rather than the top with similar size soffit locks, produce failures at forces of half or less than half that required to break the stone utilizing the soffit lock of the present invention, as shown in Table 1.

It is to be understood, however, that even though numerous characteristics and advantages of the present invention have been set forth in the foregoing description, together with details of the structure and function of the invention, the disclosure is illustrative only, and changes ay be made in detail, especially in matters of shape, size and arrangement of parts within the principles of the invention to the full extent indicated by the broad general meaning of the terms in which the appended claims are expressed.

What is claimed is:

1. An apparatus having a soffit, a mounting member and a facing member, the soffit having a recess formed therein and the facing member having a slot formed in a top edge, comprising:

the mounting member mounting to an inner surface of the facing member including an inner portion attaching to the inner surface, a hook portion extending over the top edge of the facing member and having a retaining portion inserting into the slot formed in the top edge of the facing member, a connector support portion having a threaded orifice formed therein extending substantially parallel to the retaining portion; and a threaded stud member engaging the threaded orifice and extending upward from the connector support portion and inserting into the recess.

2. An apparatus according to claim 1, wherein the stud member comprises a squared stud member having substantially planar side portions.

3. An apparatus according to claim 1, wherein the recess comprises a bore.

4. An apparatus according to claim 1, wherein the inner portion comprises a serrated surface engaging the inner surface of the facing member.

5. An apparatus according to claim 1, further comprising adhesive attaching the mounting member to the facing member.

6. An apparatus according to claim 1, further comprising a recess formed at the top edge of the facing member proximate the slot.

7. An apparatus according to claim 1, wherein the connector support portion and the retaining portion are coplanar in a vertical plane extending transversely to the facing member inner surface.

8. A mounting member retaining a facing member under a soffit with a space intermediate the soffit and the facing member, the soffit having a recess formed therein and the facing member having an inner surface, an outer surface and a top edge having a slot formed therein, comprising:

the mounting member on the inner surface of the facing member, the mounting member including a shelf portion extending from a first side of the mounting member transverse to the facing member, the shelf portion including an inner threaded orifice extending vertically therethrough, and a hook portion at an upper end on a second side of the mounting member; and a threaded stud member engaging the orifice and extending upward from the shelf portion.

9. A facing apparatus, comprising:

a top border portion having a recess formed in a lower surface;

a facing element having a top edge, a front side and a rear side, the facing element having a slot formed therein along the top edge;

a mounting member attaching to the rear side of the facing element, the mounting member including a shelf portion extending horizontally rearward from the facing element and having an inner threaded bore extending vertically therethrough, and a hook element extending over the top edge and having a retaining portion extending vertically into the slot;

a threaded retainer member engaging the inner threaded bore and extending upward therefrom for engaging the recess in the top border portion.

10. An apparatus according to claim 9, wherein the shelf portion and hook element are aligned from front to rear.

11. An apparatus attaching a stone slab to a top border stone, the top border stone having a recess formed therein along a lower surface, the stone slab having an inner surface, an outer surface, and a top edge having a slot formed therein, comprising:

a mounting member attaching to an inner surface of the stone slab, the mounting member including a first portion extending along the inner surface, a top portion extending over a portion of the top edge of the stone slab and a downward extending portion inserting into the slot, and a retainer support portion extending horizontally away from the slab and having a vertical orifice formed therein;

a retainer member elevationally adjustably mounted in the orifice and extending upward to engage the recess;

wherein the recess comprises a bore;

wherein the retainer member comprises a threaded insert and wherein the orifice includes a threaded interior surface; and wherein the retainer member includes a substantially square profile with threaded corner portions.

12. An apparatus according to claim 11, wherein the first portion comprises a serrated surface engaging the inner surface of the stone slab.

13. An apparatus according to claim 11, further comprising adhesive attaching the mounting member to the stone slab.

14. An apparatus according to claim 11, wherein the top edge includes a recess formed therein for receiving the top portion of the mounting member.

* * * * *

UNITED STATES PATENT AND TRADEMARK OFFICE

CERTIFICATE OF CORRECTION

PATENT NO. : 5,802,781

DATED : SEPTEMBER 8, 1998

INVENTOR(S) : EICKHOF

It is certified that error appears in the above-identified patent and that said Letters Patent is hereby corrected as shown below:

Col. 3, line 63: "ark" should read —mark—

Col. 4, line 50: "ay" should read —may—

Signed and Sealed this

Third Day of April, 2001

*Attest:*

Nicholas P. Godici

NICHOLAS P. GODICI

*Attesting Officer*

*Acting Director of the United States Patent and Trademark Office*